US008333222B2

(12) United States Patent
Leppla et al.

(10) Patent No.: US 8,333,222 B2
(45) Date of Patent: Dec. 18, 2012

(54) LOOM FOR PRODUCING A WOVEN ARTICLE WITH A PROFILED CROSS SECTION, IN PARTICULAR A ROPE

(75) Inventors: Klaus Leppla, Bad Sackingen (DE); Philippe Ankli, Gipf-Obertrick (CH); Bernhard Goossen, Ziefen (CH)

(73) Assignee: Textilma AG (CH)

( * ) Notice: Subject to any disclaimer, the term of this patent is extended or adjusted under 35 U.S.C. 154(b) by 160 days.

(21) Appl. No.: 12/737,421

(22) PCT Filed: Jun. 9, 2009

(86) PCT No.: PCT/EP2009/004123

§ 371 (c)(1), (2), (4) Date: Jan. 12, 2011

(87) PCT Pub. No.: WO2010/006672

PCT Pub. Date: Jan. 21, 2010

(65) Prior Publication Data

US 2011/0155276 A1 Jun. 30, 2011

(30) Foreign Application Priority Data

Jul. 15, 2008 (EP) ..... 08012744

(51) Int. Cl.
*D03D 13/00* (2006.01)
*D03D 3/02* (2006.01)
*D03D 23/00* (2006.01)

(52) U.S. Cl. ..... 139/387 R; 139/291 R; 139/192; 139/384 R

(58) Field of Classification Search ..... 139/192, 139/291 R, 305, 384 R, 387 R, 388, 390, 139/383 B; 87/35, 29, 34
See application file for complete search history.

(56) References Cited

U.S. PATENT DOCUMENTS

| | | | | | |
|---|---|---|---|---|---|
| 2,048,850 | A | * | 7/1936 | Di Lustro et al. | 87/29 |
| 2,130,636 | A | * | 9/1938 | Clutsom | 139/431 |
| 2,301,731 | A | * | 11/1942 | Martin | 87/15 |
| 2,419,741 | A | * | 4/1947 | Stone | 87/29 |
| 2,983,182 | A | * | 5/1961 | Shobert | 87/34 |
| 3,089,379 | A | * | 5/1963 | Finor et al. | 87/23 |
| 3,426,804 | A | * | 2/1969 | Bluck | 139/11 |
| 3,507,949 | A | * | 4/1970 | Campbell | 264/263 |
| 3,719,210 | A | * | 3/1973 | Emerson et al. | 139/457 |

(Continued)

FOREIGN PATENT DOCUMENTS

DE 200 00 593 U1 11/2000

*Primary Examiner* — Bobby Muromoto, Jr.
(74) *Attorney, Agent, or Firm* — George Pappas

(57) ABSTRACT

The loom contains a weaving station, at which warp yarns can be interwoven by at least one weft yarn, a device for supplying the warp yarns, and a device for supplying the at least one weft yarn. A shedding device for forming a shed from the warp yarns, and a weft insertion needle for inserting a weft yarn loop into the shed, are also present. The weft yarn loop is tied off with a knitting needle and beaten with a reed. A take-down device serves to draw off the woven fabric that is produced. In order to produce a profiled woven article, the weaving station is assigned a fabric holder with a shaping aperture whose opening cross section corresponds substantially to the cross section of the profiled woven article that is to be produced with a round or polygonal cross section.

18 Claims, 7 Drawing Sheets

U.S. PATENT DOCUMENTS 4,467,838 A * 8/1984 Rheaume ..... 139/305
4,893,543 A * 1/1990 Phillips ..... 87/34
5,368,076 A * 11/1994 Curzio ..... 139/305
5,904,714 A * 5/1999 Nunez et al. ..... 139/383 R
6,136,022 A * 10/2000 Nunez et al. ..... 623/1.1
7,500,345 B2 * 3/2009 Kish ..... 57/138
8,006,601 B2 * 8/2011 Inazawa et al. ..... 87/1
2003/0075229 A1 * 4/2003 Wendisch et al. ..... 139/11
2006/0032209 A1 * 2/2006 Rosenwasser et al. ..... 59/80
2010/0055352 A1 * 3/2010 Maxwell ..... 427/596
2010/0170990 A1 * 7/2010 Wybrow ..... 244/123.8

* cited by examiner

Fig. 2
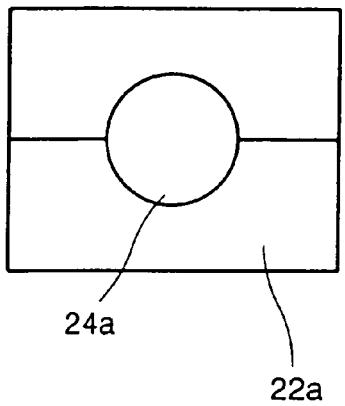
Fig. 3
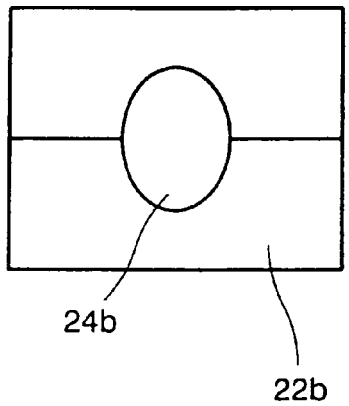
Fig. 4
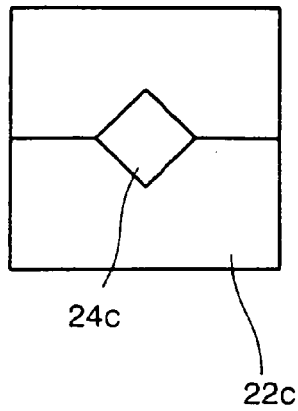
Fig. 5
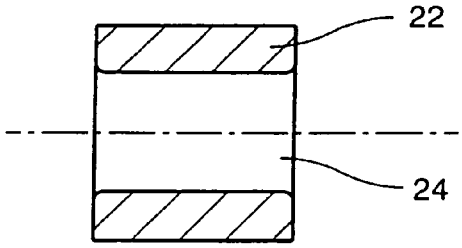
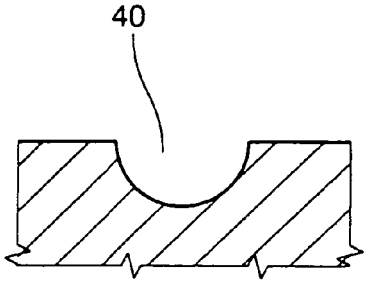
Fig. 6
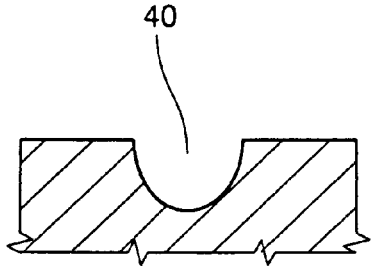
Fig. 7
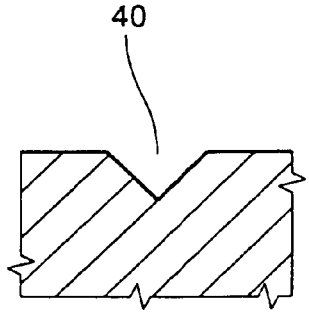
Fig. 8
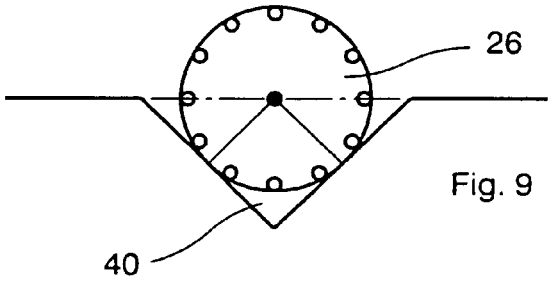
Fig. 9

LOOM FOR PRODUCING A WOVEN ARTICLE WITH A PROFILED CROSS SECTION, IN PARTICULAR A ROPE

This application claims priority of PCT application PCT/EP2009/004123 having a priority date of Jul. 15, 2008, the disclosure of which is incorporated herein by reference.

TECHNICAL FIELD

The invention relates to a weaving machine for producing a fabric having a profiled cross section, in particular a rope.

BACKGROUND OF THE INVENTION

Ropes are generally produced on laying machines or braiding machines; the disadvantage here is that these machines have limited capacity and enable only ropes of limited length.

U.S. Pat. No. 2,130,636 describes a weaving machine, of the type mentioned initially, for producing a strip, that is a flat structure, the weaving station usually being assigned a cloth holder. The cloth holder serves exclusively for holding the strip fabric, which is already flat per se, and therefore has no influence at all on profile shaping. DE 20000593 describes a device for producing a bent strip, which is connected as an additional assembly downstream of a weaving arrangement. This additional device has two take-up rollers, between which the strip produced can be bent, but the cross section thereof cannot be changed. U.S. Pat. No. 4,467,838 describes a device which is connected downstream of a weaving machine and produces a three-dimensional hollow body from the strip produced.

SUMMARY OF THE INVENTION

It is an object of the invention to design a weaving machine such that it is suitable for producing a fabric having a profiled cross section, in particular a rope.

On account of the fact that, in order to form a profile fabric, the weaving station is assigned a cloth holder having a shaping opening, the opening cross section of which corresponds substantially to the cross section of the profile fabric, having a round or polygonal cross section, the warp threads, on account of the shaping opening, are bundled in the desired form of the profile fabric and fixed in the intended position with the aid of the inserted weft thread loops and the tying off thereof. Thus, profile fabrics, in particular ropes, can be produced easily on a weaving machine at high speed and in great lengths.

The expression "warp thread" should in the present case be understood very broadly and includes not only yams, but also any other elongate structure supplied in the manner of a warp thread, which may in turn be profiles or reinforcing inserts, which have been produced as profile structures by weaving, knitting, braiding or the like.

The shaping opening of the cloth holder can be substantially circular. However, shaping openings having a substantially oval or elliptical cross section are also conceivable. The cross section of the shaping opening can be in the form of a regular or irregular polygon, in particular a triangle or rectangle.

The cloth holder advantageously has an introduction slot, formed over the length of the shaping opening thereof, for introducing the warp threads. The introduction slot is designed here such that the introduced warp threads are prevented from sliding out. For this purpose, the introduction slot preferably has a wavy form. It is also advantageous for the cloth holder to have a split form in the direction of its shaping opening, so that, by removing a part of the cloth holder, the shaping opening is accessible in order to insert the warp threads.

It is advantageous that a heddle which is prestressed transversely to the warp thread course is present in the warp thread supply device upstream of the shedding device for each warp thread, in order to equalize alternating tensile stresses or differences of length between adjacent warp threads during weaving. At least one warp thread supply can be designed for a warp thread of relatively large diameter serving as a filler and can have a corresponding tension. Expediently, each heddle or the tensioning roller is connected to a contact piece, in order to trigger an error signal in the event of insufficient warp thread tension.

It is particularly advantageous when the weaving machine, has a cloth take-up device having a multiplicity of deflection points, preferably 5 to 15 deflection points, for the profile fabric. This ensures secure driving of the profile fabric at the cloth take-up and prevents deformation of the profile fabric as would occur in the case of conventional cloth take-ups. Stresses in the profile fabric produced can also be reduced by the deflection points. The cloth take-up will preferably have a mechanical or electromechanical drive, it being advantageous when the relationship between the take-up speed and the weaving machine speed can be controlled or regulated—preferably by an adjusting mechanism or an electronic control arrangement.

Such a cloth take-up can, consist of two parallel take-up rollers, at least one of which is driven and on which the profile fabric is guided with multiple looping. The take-up rollers have different diameters from one another, this serving to improve the reduction in tension in the profile fabric. It is particularly advantageous when the take-up rollers, has for the final looping a larger diameter than in the remaining region. The take-up properties can be improved by a refinement, in which at least the driven take-up roller has a slip-inhibiting surface. It is particularly expedient when the weaving machine, has deflection points with a accommodating profile which is at least matched to the cross-sectional form of the profile fabric, in order to improve the profile consistency of the profile fabric.

It is advantageous when a deflecting roller for partially stretching the profile fabric is arranged between the cloth holder and the cloth take-up device, in order to reduce internal stresses in the profile fabric produced. The deflecting roller is preferably arranged such that the profile fabric is deflected downward, it being necessary to arrange the deflecting roller approximately in the middle between the cloth holder and the cloth take-up.

Such a weaving machine is very particularly advantageous when the cloth holder is arranged such that it can pivot through a particular angle about an axis transverse to the weaving direction, that is to say approximately parallel to the weft direction. In particular when weaving ropes, in which a weave repeat is usually provided, where the distribution of the warp threads in the upper shed with respect to the warp threads in the lower shed and vice versa is three quarters to one quarter or even more uneven (e.g. one eighth to seven eighths), geometric problems occur, particularly in needle weaving machines, with enabling the weft needle to pass through freely. Even in the case of sometimes very thick warp threads, e.g. a thick weaving core, which represents an average warp thread, the raising and lowering of the warp threads—in particular including the weaving core—into a region outside the weft region is made easier. The effect achieved in this way is improved even further when, the cloth holder, although having in the front shaping region an opening cross section which corresponds substantially to the cross section of the profile fabric to be produced, is widened in the rear region, that is to say, in the case of a rope to be woven in a circular manner, is widened upwardly and downwardly in an oval manner with approximately straight, parallel sides. This shaping then assists the pivoting movement of the cloth holder. For an explanation, reference is made to the fact that, in the case of a square shaping cross section of the cloth holder, the rear cross section is then preferably rectangular. This embodiment of the invention with a pivotable shaping cloth holder has, in particular, the advantage that, compared with a weaving machine without the pivotability measures, raising and lowering when forming the shed can be reduced with the same rope thickness or weaving core thickness to be achieved, without disrupting the ability of the weft needle—or any other well insertion arrangement—to move freely. Since raising and lowering when forming the shed has a considerable influence on the speed of weaving, a higher speed of weaving can be achieved with the measure mentioned by the reduced necessary raising and lowering when forming the shed. On the other hand, with a given weaving machine—with respect to the formation of the shed—having the measures of this advantageous embodiment, greater profile thicknesses (than e.g. rope thicknesses) can be achieved and thicker weaving cores can be processed. In principle, the pivoting movement can be driven from the outside. In the preferred embodiment, it is, however, free and is performed by the raising and lowering of the warp threads. Furthermore, it is possible to use a pivotable cloth holder even in a conventional weaving machine, in which the cloth holder is designed as a spreader for woven materials woven in the form of a strip.

The abovementioned elements and also the elements to be used according to the invention and claimed and described in the following exemplary embodiments are subject to no particular exceptions in terms of their size, shaping, use of material and their technical design, and so the selection criteria known in the respective field of use can be used in an unrestricted manner.

The person skilled in the art should recognize that on their own the following measures are already advantageous in a rope weaving machine compared with the prior art and even independently of claim 1 are able to form a separate invention:

A weaving machine for producing a fabric having a profiled cross section, in particular a rope, having a weaving station, at which warp threads can be woven together by means of at least one weft thread, having a device for supplying the warp threads, having a device for supplying the at least one weft thread, further having a shedding device for forming a shed from the warp threads, furthermore having a weft insertion needle for inserting a weft thread loop into the shed, having a knitting needle for tying off the weft thread loop, having a reed for beating up the weft thread loop, and also having a cloth holder assigned to the weaving station, and having a cloth take-up for taking up the woven cloth, in which the cloth holder has a shaping opening and an introduction slot, formed over the length of the shaping opening, for introducing the warp threads, the introduction slot being designed such that the introduced warp threads are prevented from sliding out. In this case the introduction slot preferably has a wavy form.

A weaving machine for producing a fabric having a profiled cross section, in particular a rope, having a weaving station, at which warp threads can be woven together by means of at least one well thread, having a device for supplying the warp threads, having a device for supplying the at least one well thread, further having a shedding device for forming a shed from the warp threads, furthermore having a weft insertion needle for inserting a weft thread loop into the shed, having a knitting needle for tying off the weft thread loop, having a reed for beating up the well thread loop, and also having a cloth holder assigned to the weaving station, and having a cloth take-up for taking up the woven cloth, in which a heddle for equalizing alternating tensile stresses between adjacent warp threads and prestressed transversely to the warp thread course is present in the warp thread supply device upstream of the shedding device for each warp thread, and wherein preferably at least one warp thread supply is designed for a warp thread of relatively large diameter serving as a filler and has a tensioning roller, and wherein furthermore preferably each heddle or the tensioning roller is connected to a contact piece, in order to trigger an error signal in the event of insufficient warp thread tension.

A weaving machine for producing a fabric having a profiled cross section, in particular a rope, having a weaving station, at which warp threads can be woven together by means of at least one weft thread, having a device for supplying the warp threads, having a device for supplying the at least one well thread, further having a shedding device for forming a shed from the warp threads, furthermore having a well insertion needle for inserting a well thread loop into the shed, having a knitting needle for tying off the well thread loop, having a reed for beating up the weft thread loop, and also having a cloth holder assigned to the weaving station, and having a cloth take-up for taking up the woven cloth, in which the cloth take-up has a multiplicity of deflection points, preferably 5 to 15 deflection points, for the profile fabric, the cloth take-up has a mechanical or electromechanical drive, and the relationship between the take-up speed and the weaving machine speed can be controlled or regulated, preferably by an adjusting mechanism or an electronic control arrangement, wherein the cloth take-up preferably has two parallel take-up rollers, at least one of which is driven and on which the profile fabric is guided with multiple looping, and the take-up rollers preferably have different diameters from one another. In this case, the take-up rollers preferably have for the final looping a section with a larger diameter than in the remaining region. At least the driven take-up roller preferably has a slip-inhibiting surface. Furthermore, at least a number of the deflection points have a take-up profile which is at least matched to the cross-sectional form of the profile fabric.

A weaving machine for producing a fabric having a profiled cross section, in particular a rope, having a weaving station, at which warp threads can be woven together by means of at least one weft thread, having a device for supplying the warp threads, having a device for supplying the at least one weft thread, further having a shedding device for forming a shed from the warp threads, furthermore having a weft insertion needle for inserting a weft thread loop into the shed, having a knitting needle for tying off the weft thread loop, having a reed for beating up the weft thread loop, and also having a cloth holder assigned to the weaving station, and having a cloth take-up for taking up the woven cloth, in which a deflecting roller for partially stretching the profile fabric is arranged between the cloth holder and the cloth take-up. The deflecting roller preferably deflects the profile fabric downward and is arranged approximately in the middle between the cloth holder and the cloth take-up.

A weaving machine having a weaving station, at which warp threads can be woven together by means of at least one well thread, having a device for supplying the warp threads, having a device for supplying the at least one well thread, further having a shedding device for forming a shed from the warp threads, furthermore having a well insertion needle for inserting a weft thread loop into the shed, having a knitting needle for tying off the well thread loop, having a reed for beating up the well thread loop, and also having a cloth holder or spreader assigned to the weaving station, and having a cloth take-up for taking up the woven cloth, in which the cloth holder is arranged such that it can pivot about an axis transverse to the cloth running direction and preferably its shaping opening has an upwardly and downwardly widened form in the rear region.

BRIEF DESCRIPTION OF THE DRAWINGS

Exemplary embodiments of the invention will be described in more detail below with reference to schematic drawings, in which:

FIG. 2 shows a cloth holder having a shaping opening with a circular cross section, FIG. 3 shows a cloth holder having a shaping opening with an elliptical cross section, FIG. 4 shows a cloth holder having a shaping opening with a rectangular cross section, FIG. 5 shows a longitudinal section through a cloth holder, FIG. 6 shows a semicircular accommodating profile of a deflection point, FIG. 7 shows a semielliptical accommodating profile of a deflection point, FIG. 8 shows a wedge-shaped accommodating profile of a deflection point, FIG. 9 shows the accommodating profile in FIG. 8 with a rope inserted.

DETAILED DESCRIPTION OF THE PREFERRED EMBODIMENTS

Figure 1A:
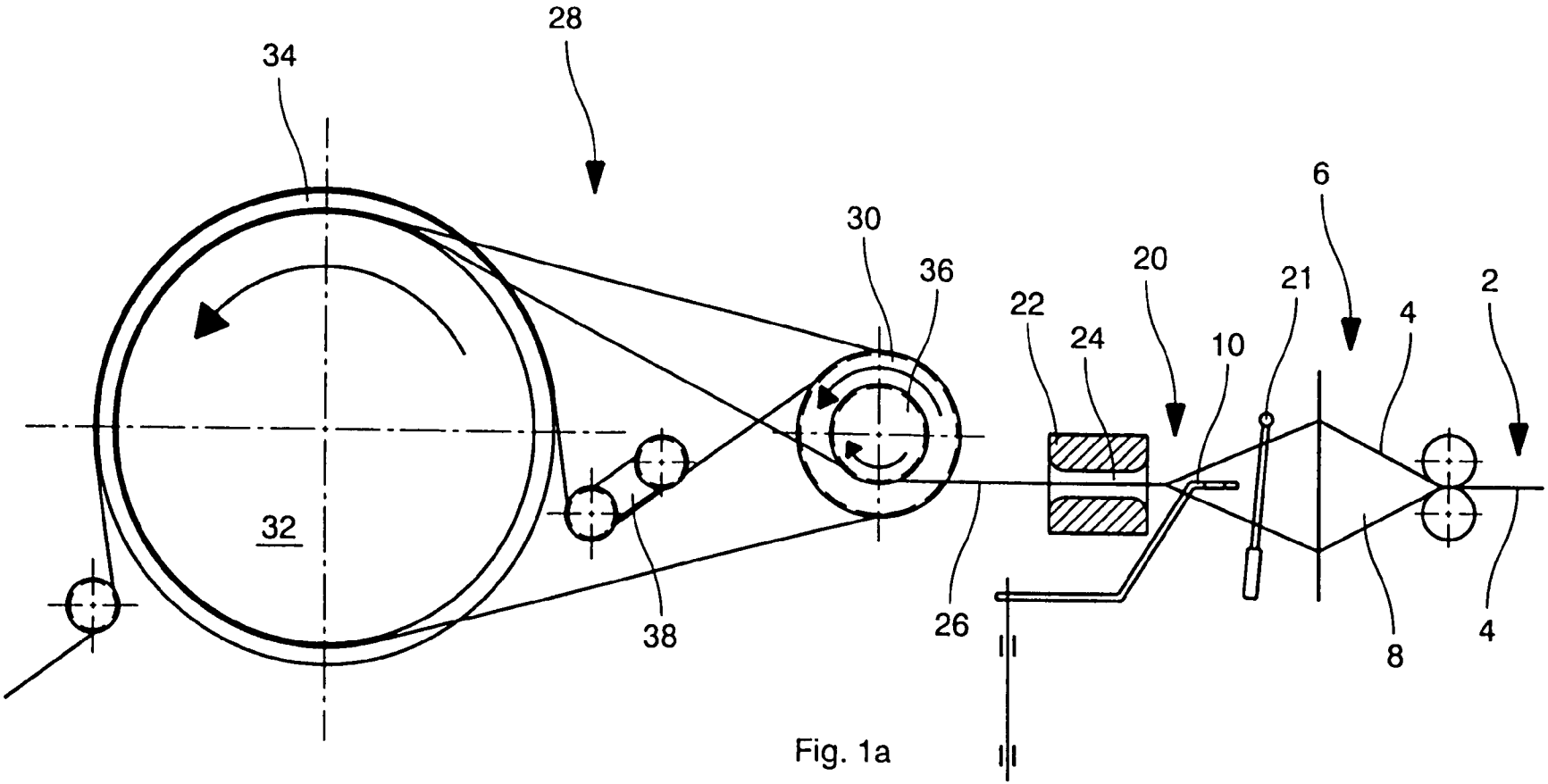
FIG. 1*a* shows a side view of a weaving machine.
Figure 1B:
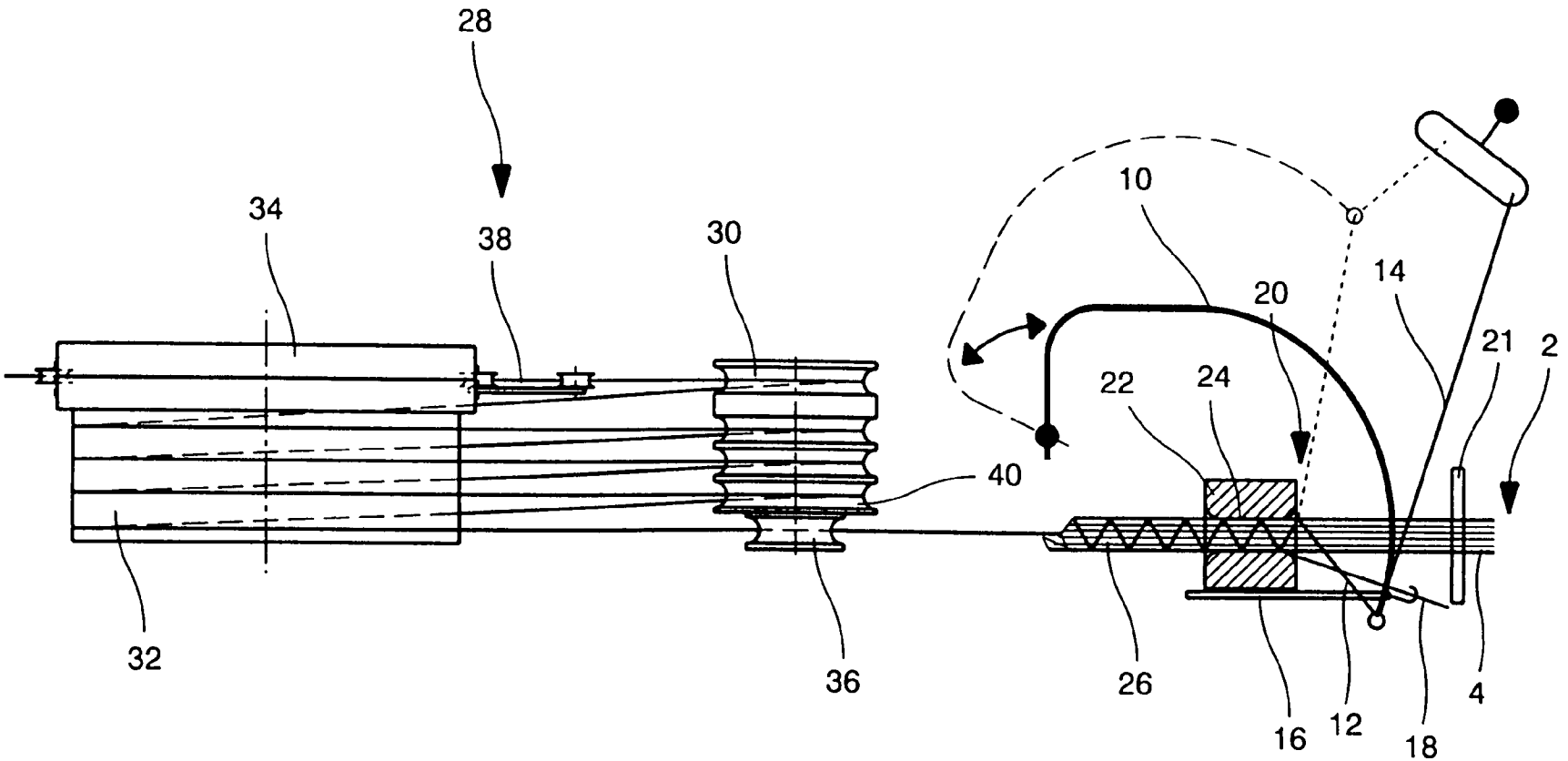
FIG. 1*b* shows a plan view of the weaving machine in FIG. 1*a*.

FIGS. 1*a* and 1*b* schematically illustrate a side view and a plan view of a weaving machine, which has a device 2 for supplying warp threads 4. By means of a shedding device 6, the warp threads 4 are opened to form a shed 8, so that a weft thread loop 12 of a weft thread 14 can be inserted into the shed 8 by means of a weft insertion needle 10. The weft thread loop 12 is tied off on the side facing away from the insertion side by means of a knitting needle 16. The weft thread loop 12 can be tied off using the weft thread loop which has already been inserted, but tying off preferably takes place with the aid of an auxiliary thread 18. Tying off advantageously takes place such that the inserted weft thread loops 12 are prevented from rippling. At the weaving station 20, the inserted and tied off weft thread loop is beaten up by means of a reed 21 and supplied to the cloth holder 22, which has a shaping opening 24, the opening cross section of which corresponds substantially to the cross section of the profile fabric 26 to be produced. The warp threads 4 are kept at the weaving station 20, already in the desired form of the final profile fabric, with the aid of the shaping opening 24 and this form is kept by the inserted and tied off weft thread loops 12.

FIGS. 2 to 4 show cloth holders 22*a*, 22*b* and 22*c* having different shaping openings 24*a*, 24*b* and 24*c* with circular, elliptical and polygonal, such as quadrilateral, cross sections. The cloth holders have a split form along their horizontal mid-plane, so that a part can be removed in order to make it easier to insert the warp threads. However, it is also possible to provide, for example along the mid-plane on one side of the cloth holder, an introduction slot (not shown in more detail) for introducing the warp threads. In order to make it difficult for the warp threads to slide out, the introduction slot can have a wavy form.

FIG. 5 shows a longitudinal section through the cloth holder 22. In order to reduce the frictional resistance of the profile fabric in the shaping opening 24, the latter can have a slightly widening cross section in the running direction of the profile fabric. The profile fabric 26 emerging from the cloth holder 22 is taken up by means of a cloth take-up 28 at which the profile fabric is guided in multiple looping in order that the profile fabric is taken up securely and that deformation of the profile fabric is prevented.

The cloth take-up 28 has two rollers 30, 32, which are spaced apart from one another, and of which the roller 30 facing the cloth holder 22 has a smaller diameter and the roller 32 facing away from the cloth holder 22 has a larger diameter. For the last turn, the roller 32 has a section 34 having an even larger diameter, in order to enable satisfactory discharging of the profile fabric 26. A running roller 36 having a relatively small diameter forms the run-in to the cloth take-up 28. In order to supply the profile fabric 26 to the final section 34 on the roller 32, a securing device 38 is additionally provided, in order that the profile fabric 26 is driven securely at the section 34 and that an alarm signal is triggered in the event of a malfunction. The rollers 30 and 32 can be provided with a slip-free coating and/or have accommodating profiles 40, which are matched to the cross section of the profile fabric 26 produced, as can be gathered from FIGS. 6 to 8. Particularly advantageous is the refinement according to FIG. 9, in which the accommodating profile 40 is designed such that the chord of the profile fabric lies at the level of the lateral surface 42 of the roller, so that the tensile force acts as far as possible in the central axis, that is the neutral fiber of the profile fabric.

Figure 10:
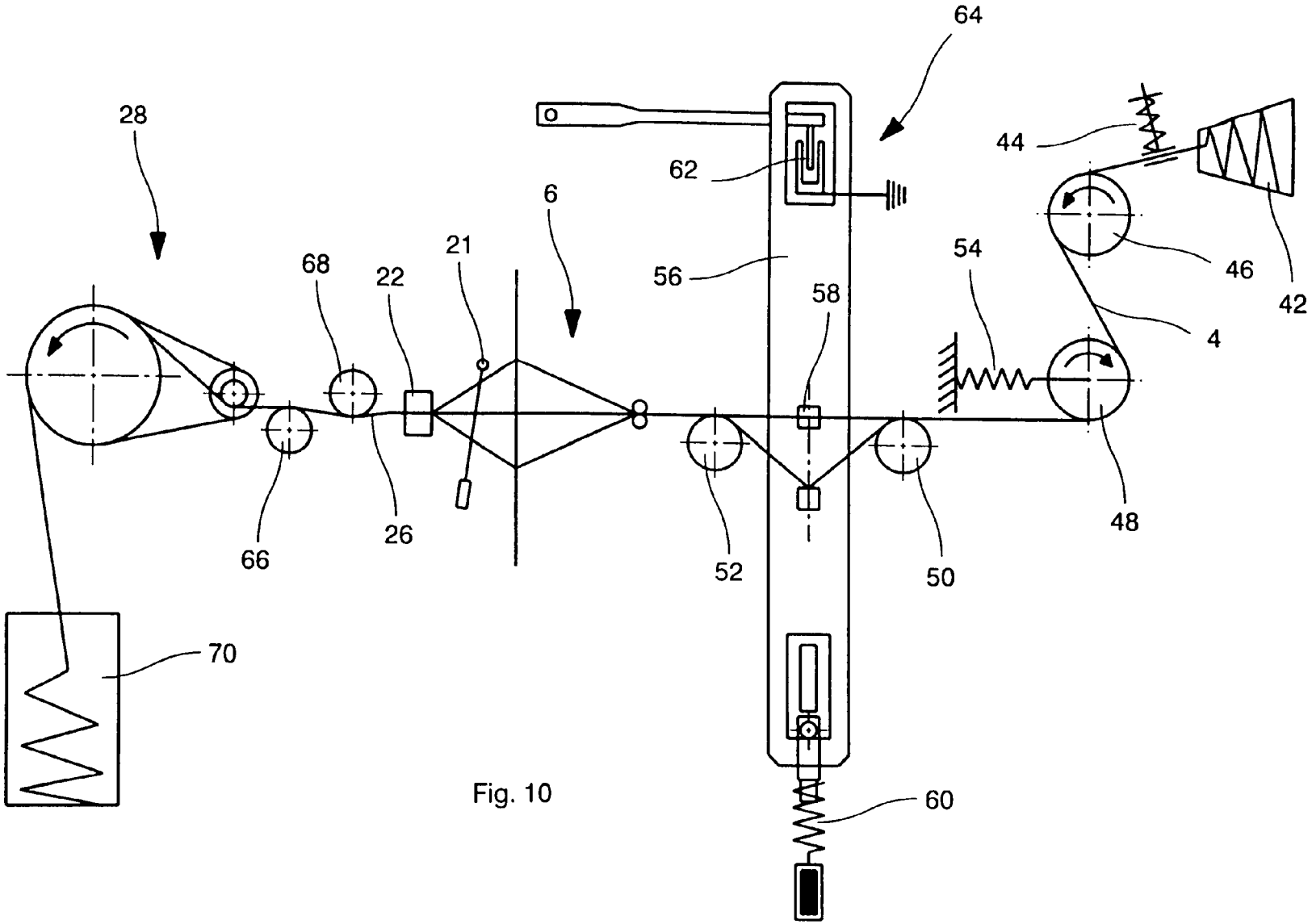
FIG. 10 shows a schematic side view of a further weaving machine.

FIG. 10 shows further refinements of a weaving machine in FIGS. 1*a* and 1*b*. The device 2 for supplying warp threads 4 comprises for each warp thread a thread cone 42, from which the warp thread 4 is supplied, via a thread brake 44, to rollers 46, 48. From there, the warp thread 4 runs via two guide rods 50, 52 to the shedding device 6. The roller 48 is prestressed against the warp thread 4 by means of a spring 54. Between the guide rods 50, 52 there is provided for each warp thread a lifting heddle 56, in which the warp thread 4 is guided through an eyelet 58. The lifting heddle 56 is prestressed downwardly by means of a spring 60, in order to equalize fluctuations, which occur during weaving, between adjacent warp threads. At the upper end of the lifting heddle there is positioned a contact rail 62 of a warp stop motion 64, which is activated if a warp thread breaks or the warp thread sags impermissibly. It should be noted that the illustration of the warp thread course via the guide rails 50, 52 in relation to the contact rail 62 of the warp stop motion is not true to scale, but rather is schematic.

Between the cloth holder 22 and the cloth take-up 28, a guide roller 66 and a stretching roller 68 are arranged such that the profile fabric 26 is deflected slightly downward between the cloth holder 22 and the guide roller 66. This deflection has the purpose of stretching the profile at the cloth holder 22 and at the guide roller 66 in the upper region and in the region of the stretching roller 68 in the lower region. This has a positive influence on the warp thread tension of the profile fabric produced. A container 70 for accommodating the finished profile fabric 26 is assigned to the cloth take-up 28.

Figure 11:
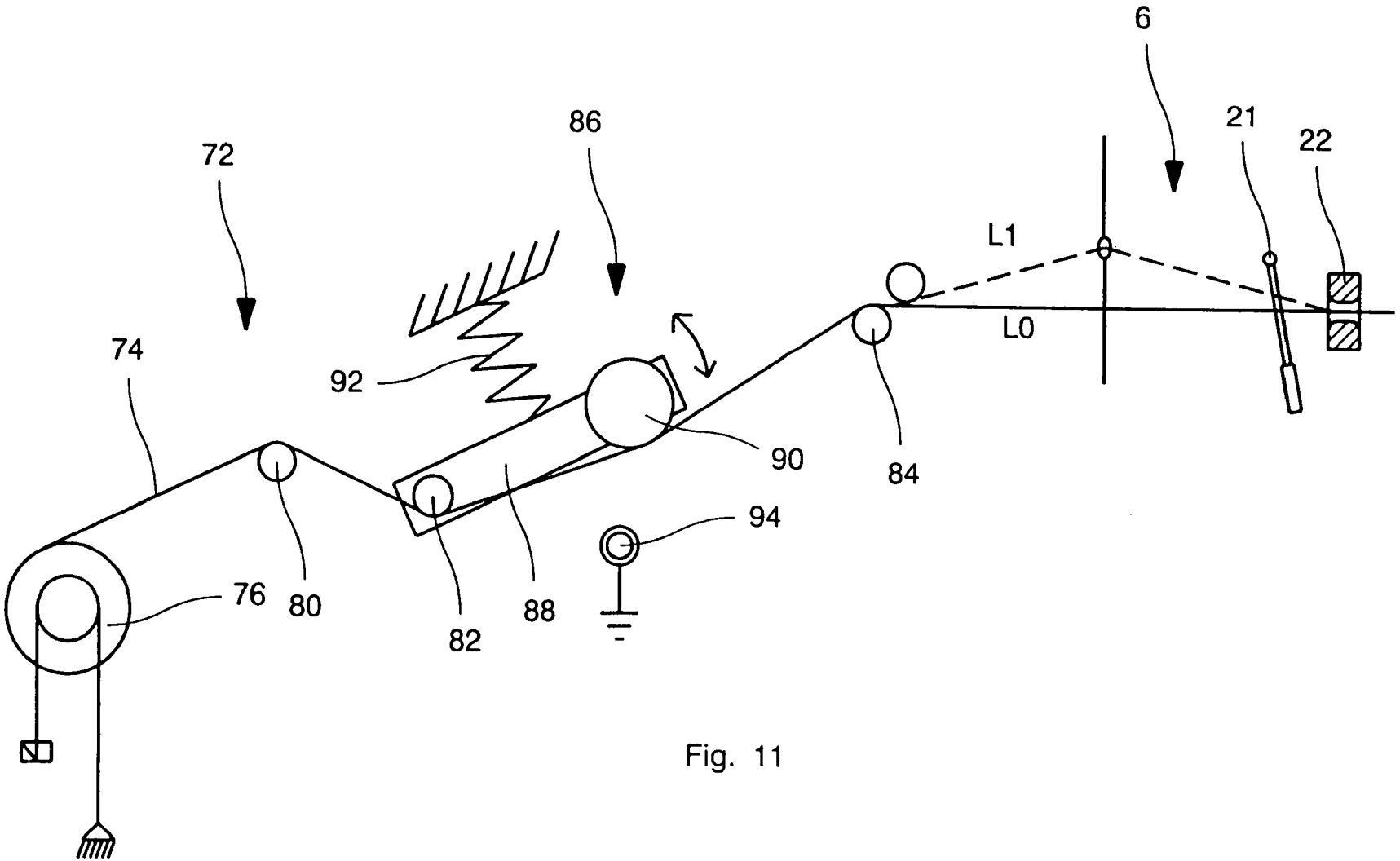
FIG. 11 shows a device for supplying a filler.

FIG. 11 shows a device 72 for supplying a filler 74 at the weaving machine. A filler of this kind can have properties and dimensions which are very different from the rest of the warp threads. Thus, the filler can consist of plastic material, steel wire or steel cable or have a cross section which is substantially larger than that of the warp threads. Thus, the filler can, for example, be a tubular structure. Since it is more difficult to handle the filler 74 than the rest of the warp threads, special measures are require for supplying it. The supply device 72 for the filler 74 comprises firstly a filler bobbin 76, which is connected to a braking device 78. The filler 74 taken up from the filler bobbin 76 is guided over various guides 80, 82, 84 to the shedding device 6. Between the guides 80 and 84 there is provided a tensioning device 86, which has a rocker arm 88, secured to which is a clamping roller 90 which is prestressed against the filler 74 by means of a spring 92. Assigned to the rocker arm 88 is a contact point 94, which the rocker arm 88 strikes if the filler 74 is broken or the prestress of the filler is not strong enough.

A wide variety of profile fabrics can be produced by means of the weaving machine, in particular ropes having a wide variety of structures. The weaving machine enables higher production speeds than braiding machines and enables ropes having great lengths to be produced.

Figure 12:
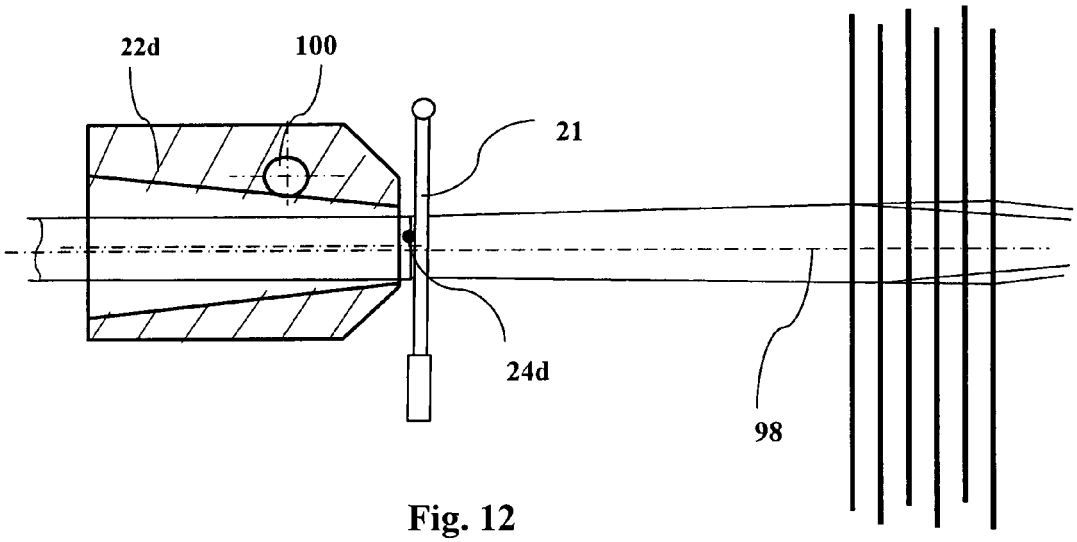
FIG. 12 shows a weaving machine of a further embodiment of the present invention, having a pivotable cloth holder, the cloth holder being located in the normal or middle position.
Figure 13:
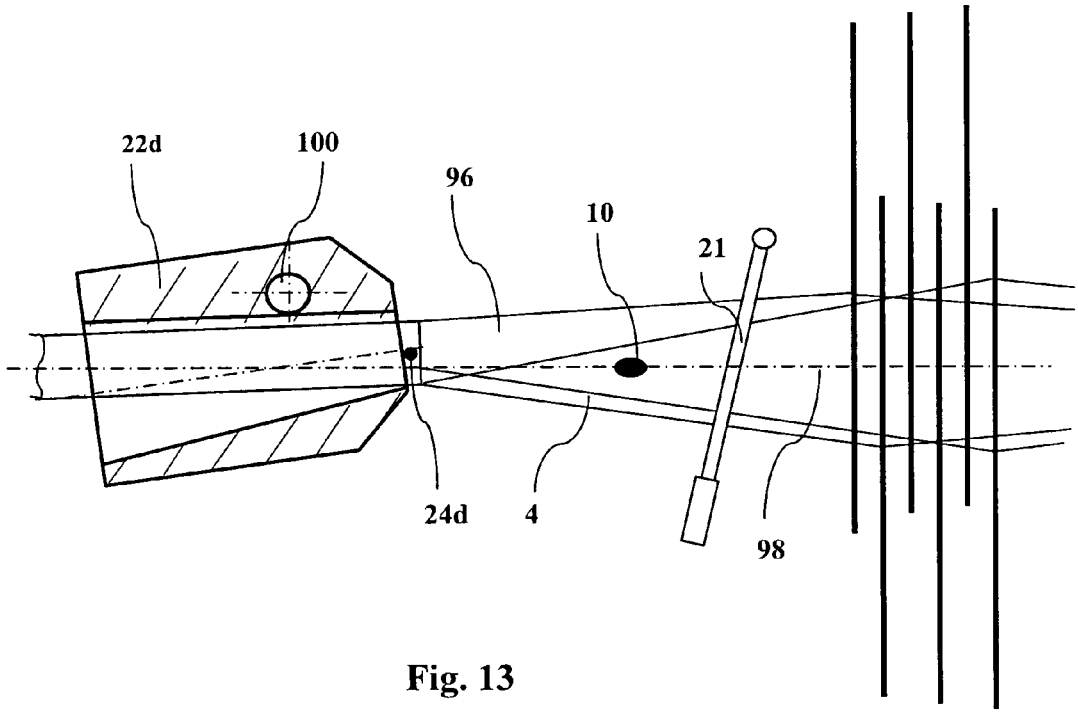
FIG. 13 shows a weaving machine of a further embodiment of the present invention, having a pivotable cloth holder, the cloth holder being located in a strongly raised position.
Figure 14:
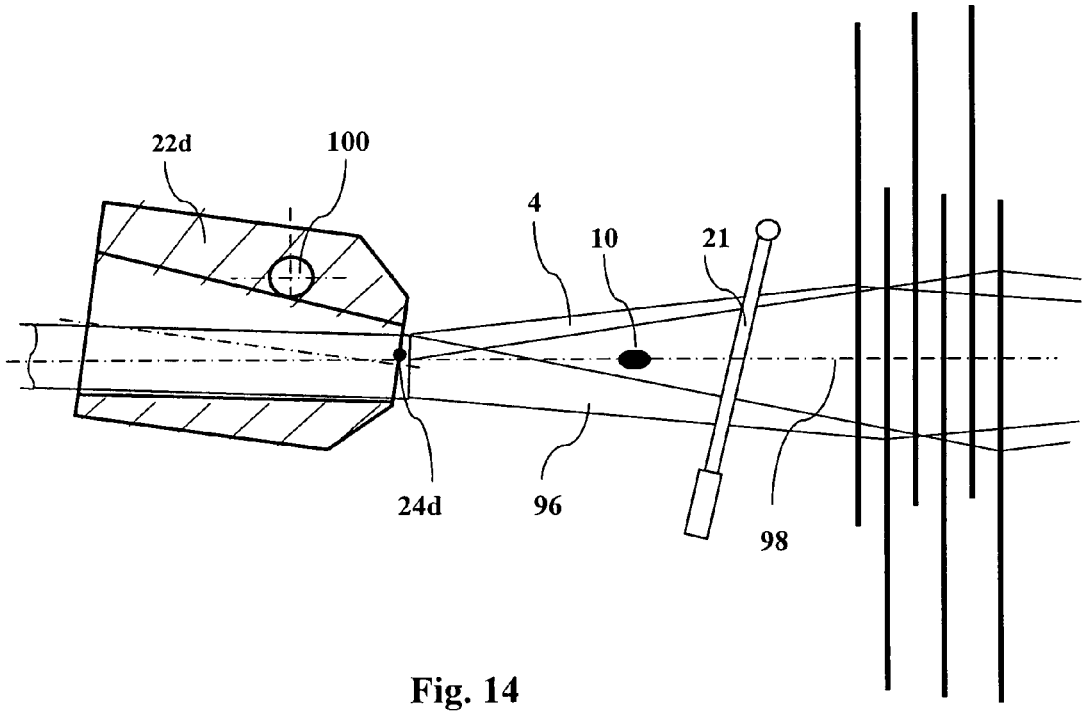
FIG. 14 shows a weaving machine of a further embodiment of the present invention, having a pivotable cloth holder, the cloth holder being located in a slightly raised position.
Figure 15:
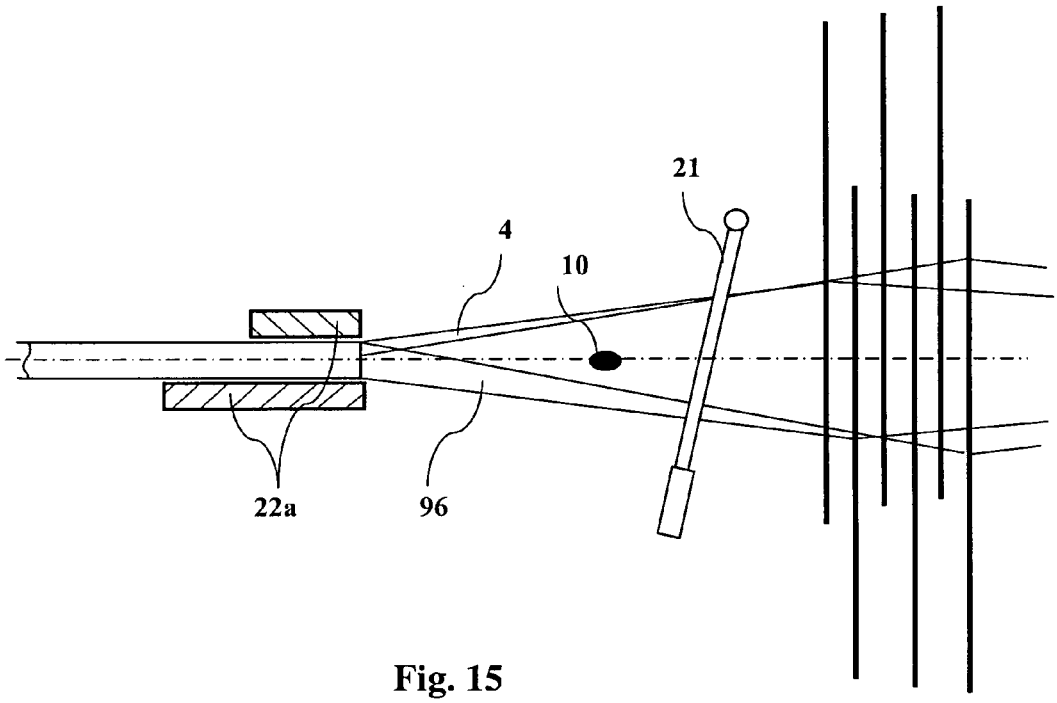
FIG. 15 shows a comparison to illustrate the increase in the raising and lowering range of the weaving machine according to FIG. 12 with respect to a weaving machine without the measures of this further embodiment.

FIGS. 12 to 15 show a weaving machine in a further improved embodiment of the present invention, having a pivotable cloth holder 22*d*. In FIG. 12, the cloth holder is located in the normal or middle position, and the warp threads are neither raised nor lowered. In FIG. 13, the cloth holder is in a position, in this weaving machine, which corresponds to a "strongly raised" position. Here, "strongly raised" means that most warp threads 4, typically more than 75%, are raised, while fewer than 25% of the warp threads 4 are lowered, or wherein, if a thicker and harder weaving core 96 is used, this weaving core 96 is raised. In this case, the distribution of the further, thinner warp threads 4 is less important. In FIG. 14, the cloth holder 22*d* is in a position, in this weaving machine, which corresponds to a "slightly raised" position. Here, "slightly raised" means that most warp threads 4, typically more than 75%, are lowered, while fewer than 25% of the warp threads 4 are raised or wherein, if a thicker and harder weaving core is used, this weaving core 96 is lowered. In this case, the distribution of the further, thinner warp threads 4 is again less important. FIG. 15 shows a comparison to illustrate the increase in the raising and lowering range of the weaving machine according to FIG. 12 with respect to a weaving machine without the measures of this improved embodiment. The effect achieved thereby is further improved in the present exemplary embodiment, in that, although the cloth holder 22*d* in the front shaping region has the circular opening cross section 24*d*, which corresponds to the cross section of the rope in the example of a round rope, in the rear region it is widened. The cross section of the rear opening is in this case widened upwardly and downwardly in an oval manner, the widening being formed by straight, parallel sides. The widening is linear within the cloth holder 22*d*, i.e. the straight, parallel side lengths forming the widening increase in the exemplary embodiment shown here from zero (at the front) to the full side length (at the rear). This shaping assists the pivoting movement of the cloth holder 22*d*. In the exemplary embodiment shown here, the pivotable cloth holder 22*d* can pivot freely above the shaping opening 24*d* about an axis 100 transversely to the weaving direction, the pivotability being limited by the shaping and by the cloth (rope) being guided through. Of course, the pivotable, shaping cloth holder 22*d* is positioned such that in all pivoting states the reed 21 stops in front of the cloth holder 22*d*—in each of its pivoting positions—without touching it. For an explanation, reference is made to the fact that, in the case of a square shaping cross section of the pivotable cloth holder—i.e. when a square rope is intended to be woven—the rear cross section is then preferably rectangular.

LIST OF REFERENCES

2 Supply device for warp thread
4 Warp thread
6 Shedding device
8 Shed
10 Weft insertion needle
12 Weft thread loop
14 Weft thread
16 Knitting needle
18 Auxiliary thread
20 Weaving station
21 Reed
22,*a,b,c,d* Cloth holder
24,*a,b,c,d* Shaping opening
26 Profile fabric
28 Cloth take-up
30 Roller
32 Roller
34 Section
36 Running roller
38 Securing device
40 Accommodating profile
42 Thread cone
44 Thread brake
46 Roller
48 Roller
50 Guide rod
52 Guide rod
54 Spring
56 Lifting heddle
58 Eyelet
60 Spring
62 Contact rail
64 Warp stop motion
66 Guide roller
68 Stretching roller
70 Container
72 Supply device
74 Filler
76 Filler bobbin
78 Braking device
80 Guide
82 Guide
84 Guide
86 Tensioning device
88 Rocker arm
90 Tensioning roller
92 Spring
94 Contact point

96 Weaving core
98 Neutral axis
100 Pivot axis of the cloth holder

The invention claimed is:

1. A weaving machine for producing a fabric having a profiled cross section, in particular a rope, having a weaving station, at which warp threads can be woven together by means of at least one weft thread, having a device for supplying the warp threads, having a device for supplying the at least one weft thread, further having a shedding device for forming a shed from the warp threads, furthermore having a weft insertion needle for inserting a weft thread loop into the shed, having a knitting needle for tying off the weft thread loop, having a reed for beating up the weft thread loop, and also having a cloth holder assigned to the weaving station, and having a cloth take-up for taking up the woven cloth, characterized in that, in order to form a profile fabric, the cloth holder has a shaping opening, the opening cross section of which corresponds substantially to the cross section of the profile fabric to be produced, having a round or polygonal cross section.

2. The weaving machine as claimed in claim 1, characterized in that the cross section of the shaping opening is substantially circular, oval or elliptical.

3. The weaving machine as claimed in claim 1, characterized in that the cross section of the shaping opening is in the form of a triangle or rectangle.

4. The weaving machine as claimed in claim 1, characterized in that the cloth holder has an introduction slot, formed over the length of the shaping opening thereof, for introducing the warp threads, the introduction slot being designed such that the introduced warp threads are prevented from sliding out.

5. The weaving machine as claimed in claim 4, characterized in that the introduction slot has a wavy form.

6. The weaving machine as claimed in claim 1, characterized in that a heddle for equalizing alternating tensile stresses between adjacent warp threads and prestressed transversely to the warp thread course is present in the warp thread supply device upstream of the shedding device for each warp thread.

7. The weaving machine as claimed in claim 6, characterized in that at least one warp thread supply is designed for a warp thread of relatively large diameter serving as a filler and has a tensioning roller.

8. The weaving machine as claimed in claim 7, characterized in that each heddle or the tensioning roller is connected to a contact piece, in order to trigger an error signal in the event of insufficient warp thread tension.

9. The weaving machine as claimed in claim 1, characterized in that the cloth take-up has a multiplicity of deflection points, preferably 5 to 15 deflection points, for the profile fabric, the cloth take-up has a mechanical or electromechanical drive, and in that the relationship between the take-up speed and the weaving machine speed can be controlled or regulated, preferably by an adjusting mechanism or an electronic control arrangement.

10. The weaving machine as claimed in claim 9, characterized in that the cloth take-up has two parallel take-up rollers, at least one of which is driven and on which the profile fabric is guided with multiple looping.

11. The weaving machine as claimed in claim 10, characterized in that the take-up rollers have different diameters from one another.

12. The weaving machine as claimed in claim 11, characterized in that the take-up rollers have for the final looping a section with a larger diameter than in the remaining region.

13. The weaving machine as claimed in claim 12, characterized in that at least the driven take-up roller has a slip-inhibiting surface.

14. The weaving machine as claimed in claim 13, characterized in that at least a number of the deflection points have an accommodating profile which is at least matched to the cross-sectional form of the profile fabric.

15. The weaving machine as claimed in claim 1, characterized in that a deflecting roller for partially stretching the profile fabric is arranged between the cloth holder and the cloth take-up, the deflecting roller preferably deflecting the profile fabric downward and being arranged preferably approximately in the middle between the cloth holder and the cloth take-up.

16. The weaving machine as claimed in claim 1, characterized in that the cloth holder is arranged such that it can pivot about an axis transverse to the cloth running direction.

17. The weaving machine as claimed in claim 16, characterized in that the shaping opening of the cloth holder has a widened form in the rear region.

18. The weaving machine as claimed in claim 17, characterized in that the cloth holder has a circular form in its front, shaping opening and widens toward the rear to form an upwardly and downwardly oval output having approximately straight, parallel sides.

* * * * *

UNITED STATES PATENT AND TRADEMARK OFFICE

CERTIFICATE OF CORRECTION

PATENT NO. : 8,333,222 B2
APPLICATION NO. : 12/737421
DATED : December 18, 2012
INVENTOR(S) : Klaus Leppla et al.

It is certified that error appears in the above-identified patent and that said Letters Patent is hereby corrected as shown below:

Column 1, line 51, change "yams" to --yarns--

Column 3, line 17, change "well" to --weft--

Column 3, line 66, change "well" to --weft--

Column 4, line 1, change "well" to --weft--

Column 4, line 5, change "well" to --weft--

Column 4, line 23, change "well" to --weft--

Column 4, line 24, change "well" to --weft--

Column 4, line 25, change "well" to --weft--

Column 4, line 26, change "well" to --weft--

Column 4, line 65, change "well" to --weft--

Column 4, line 66, change "well" to --weft--

Column 5, line 1, change "well" to --weft--

Column 5, line 3, change "well" to --weft--

Column 5, line 4, change "well" to --weft--

Signed and Sealed this
Twenty-sixth Day of February, 2013

Teresa Stanek Rea

Teresa Stanek Rea
*Acting Director of the United States Patent and Trademark Office*